United States Patent [19]

Horowitz et al.

[11] 4,207,828

[45] Jun. 17, 1980

[54] STABILIZING SYSTEM FOR A CRANE VESSEL

[75] Inventors: Alexandre Horowitz, Eindhoven, Netherlands; Pieter S. Heerema, Kapellen, Belgium; Henricus P. Willemsen, Aarle-Rixtel, Netherlands

[73] Assignee: Varitrac AG., Zug, Switzerland

[21] Appl. No.: 869,233

[22] Filed: Jan. 13, 1978

[30] Foreign Application Priority Data

Jan. 20, 1977 [NL] Netherlands ..... 7700589

[51] Int. Cl.[2] ..... B63B 39/03; B63B 43/06

[52] U.S. Cl. ..... 114/125; 114/265; 212/3 R; 9/8 P

[58] Field of Search ..... 212/3; 114/121, 122, 114/125, 264, 265, 61, 26; 9/8 P

[56] References Cited

U.S. PATENT DOCUMENTS

| | | | |
|---|---|---|---|
| 1,007,348 | 10/1911 | Frahm | 114/125 |
| 3,537,412 | 11/1970 | Henderson | 114/125 |
| 3,716,154 | 2/1973 | Berg | 114/125 |
| 3,886,886 | 6/1975 | Anders | 114/125 |
| 3,894,503 | 7/1975 | McClure | 212/3 |

FOREIGN PATENT DOCUMENTS

| | | | |
|---|---|---|---|
| 321470 | 10/1934 | Italy | 114/125 |

*Primary Examiner*—Trygve M. Blix
*Assistant Examiner*—D. W. Keen
*Attorney, Agent, or Firm*—Haseltine, Lake & Waters

[57] ABSTRACT

A stabilizing system for a crane vessel of the twin hull semi-submersible type having a working platform supported above sea level by columns on submersible hulls. Water ballast compartments above sea level on the corner columns are discharged selectively in order to stabilize the vessel during handling of heavy outboard loads by cranes. The water is discharged through controlled valves of special construction. This control is regulated in dependence of measured values of the moment of force applied on the vessel by the crane load, and effects the operation with the help of a computer.

Lower water ballast compartments in the columns have an additional "passive" function and the water can be discharged therefrom by pressurized air or by pumping it into the upper ballast compartments.

13 Claims, 11 Drawing Figures

L
15
A1
A2
D+3S
13
B1
B2

STABILIZING SYSTEM FOR A CRANE VESSEL

DISCLOSURE OF THE PRIOR ART

The invention relates to a stabilizing system for a crane vessel with subaqueous hulls which, by means of hollow columns, bear a working platform with the cranes located above the level of the surrounding water, particularly for the outboard displacement of relatively high weights, such as weights of over 250 tons, for instance 3000 tons.

In U.S. Pat. No. 3,835,800 it has been proposed to equip a vessel with subaqueous hulls supporting by means of columns a working platform located above the sea level of the general "half-submergile" type, such as this is customary for floating drilling towers, with crane (by which is also to be understood a derrick) and then to apply a certain limited stabilizing system for its use as a so-called "Workvessel", making use of the normal ballast tanks which are built in the subaqueous hulls.

Use is made of the displacement of water ballast in the ballast tanks as a result of which the vessel is given in advance a list opposite to the list caused when lifting an outboard load. However, the list which may be admitted to both sides remains limited and as a result thereof only comparatively little loads may be handled in a limited radius perpendicular on the centerline of the vessel.

Moreover, the continuously alternating list occurring during the work is troublesome for the work and for the stay onboard a similar work vessel.

In order to be able to displace also higher crane-loads outboard in the work vessel according to this known embodiment the hull ballast chambers had to be emptied to such an extent that the hulls floated upward, and due to the strongly increased stability in this floating condition, also heavier loads, for instance of 250 tons, could then be handled, but only on quiet sea.

In our copending application Ser No. 769,002 an improved stabilizing system has been described by which the vessel can be continuously maintained at substantially horizontal level during outboard handling of heavy loads with the application of a computer for the control of additional water ballast compartments in the columns.

BACKGROUND OF THE INVENTION

The type of vessel with subaqueous hulls is, in fact, constructed with a view to being affected at sea as little as possible by the wave motion, thus to achieve a quiet position by the motion-limiting properties with regard to pitching, rolling and heaving. This thanks to the fact that the buoyancy is substantially derived from hulls located entirely below the water level which, only by means of columns, are connected with the working platform borne above the water level. On the other hand, such a vessel has a comparatively low stability. For use as a drilling island this is no objection since the fixed drilling tower is positioned centrally, but on a similar ship only cranes with a low lifting power can be applied because an eccentric load causes a considerable list.

It would be of great advantage if the favorable properties of a vessel of the abovementioned type as to its quietness in a rough sea could be used for a so-called "work-vessel" provided with a derrick and/or cranes suitable for carrying out jobs at sea, for instance for erecting and dismantling production platforms and for other off-shore transport functions.

SUMMARY OF THE INVENTION

The invention seeks to provide a stabilizing system by which a vessel of the said type can be used as a work vessel which is held practically horizontal in the case of outboard handling of heavy loads by the cranes of the vessel, namely in the submerged situation, thus applicable at wave heights of far over 1.50 m.

Starting from the state of the art described in the introduction, in the stabilizing system according to the invention, ballast-water compartments are spaced along the circumference of the vessel in the superstructure thereof above the water level, the water capacity of these compartments stands to the maximum load to be displaced in such a proportion that by selectively emptying these ballast containers a load-compensation may be achieved by the controlled operation of discharge valves commanding chutes from the water compartments to the surrounding water, a device being added at the command center for selective command of the chute valves of the various water compartments in dependence on the moment of force applied on the vessel by the crane load.

This, therefore, means that the water ballast system in the hull tank serves only to give the vessel, when at rest, thus in the starting situation, a horizontal position. However, while the crane is working, an additional stabilizing system is activated for which the top ballast volumes comprised in the water compartments above the sea level are individually subjected to selective control.

It has been found that according to the invention, rapid and reliable compensation of the moments of force occurring on the vessel when manipulating loads may be achieved by the application of simple means to an extent that the vessel, which in the half-submerged position is only to a slight degree affected by the swell and the dash of the waves, may be used for the manipulation of heavy loads of, for instance, 3000 tons, thus serving as a so-called work vessel in every respect.

BRIEF SURVEY OF THE DRAWINGS

Figure 1:
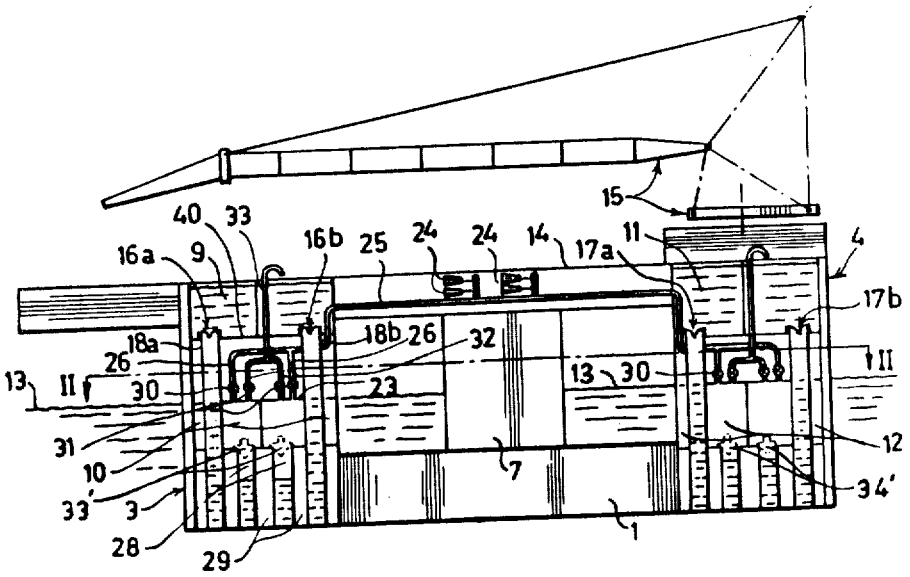
FIG. 1 is a vertical longitudinal cross-section of a vessel according to the invention taken along line I—I in FIG. 2.
Figure 7:
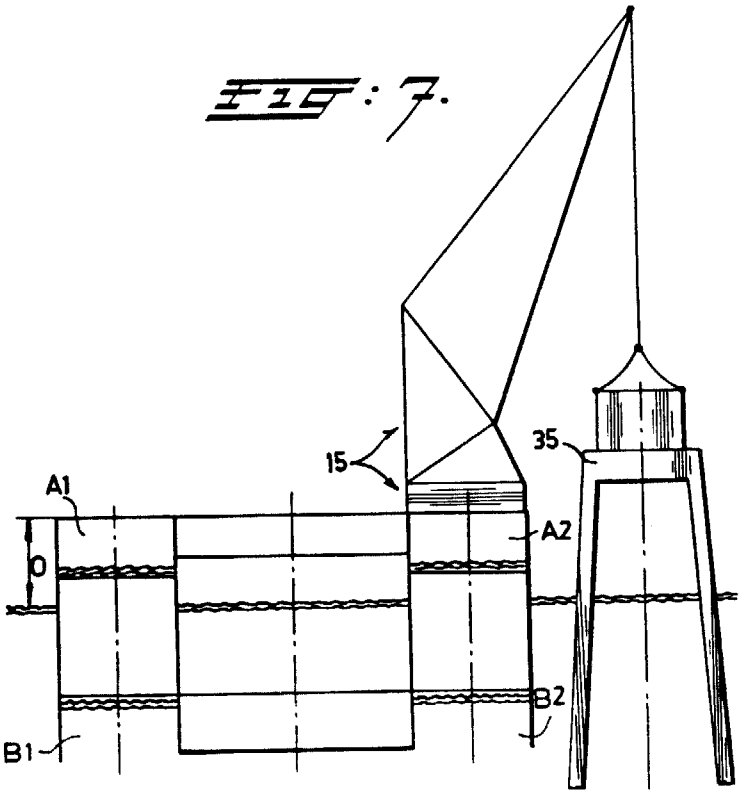
Figure 9A:
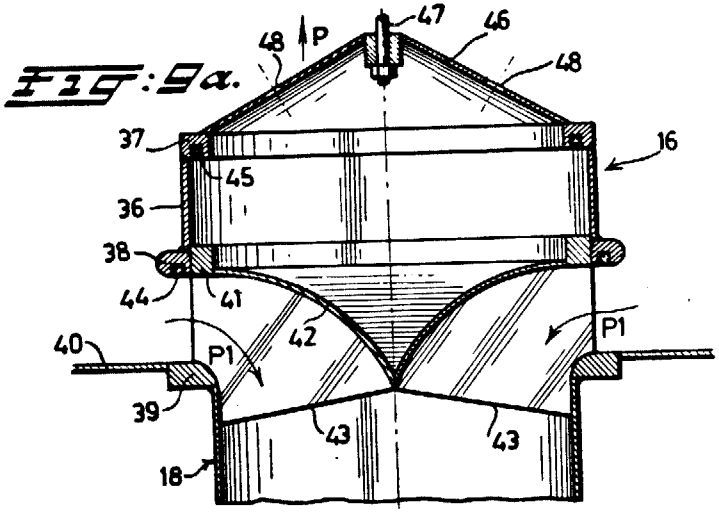
Figure 9B:
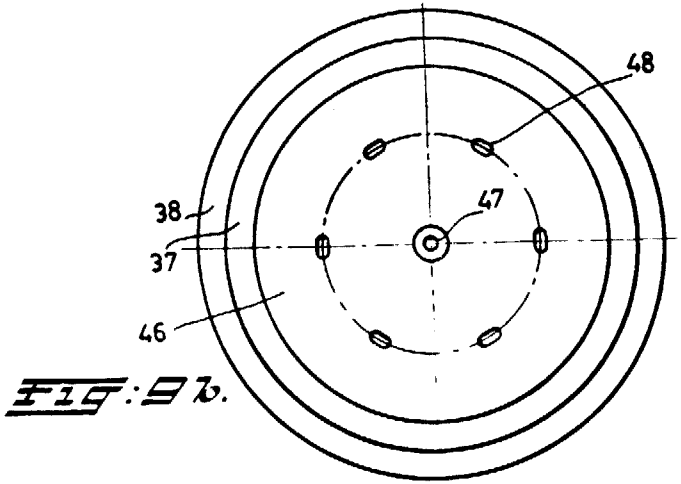
Figure 8A:
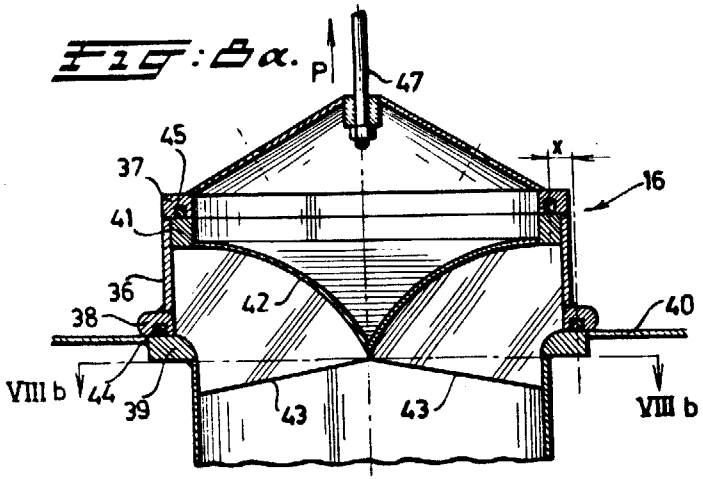
Figure 8B:
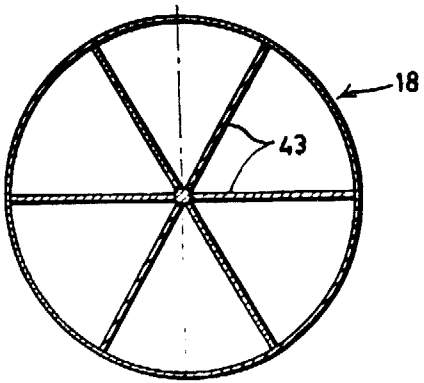

FIG. 3 is a simplified cross sectional sketch corresponding to FIG. 1 with indications on behalf of the calculation in an example of an embodiment illustrated in a starting situation FIGS. 4–7 each show a cross-section in the sense of FIG. 3 for consecutive situations in manipulations of the load FIGS. 8*a* and 8*b* show the upper portion of a water chute with a closed chute valve, respectively in a vertical axial cross section taken and a horizontal cross section along the line VIIIb—VIIIb in FIG. 8*a*, and FIGS. 9*a* and 9*b* show, respectively, a cross section with opened chute valve corresponding with FIG. 8*a* and a top view associated with FIG. 8*a* and 8*b*.

DETAILED DESCRIPTION

Figure 2:
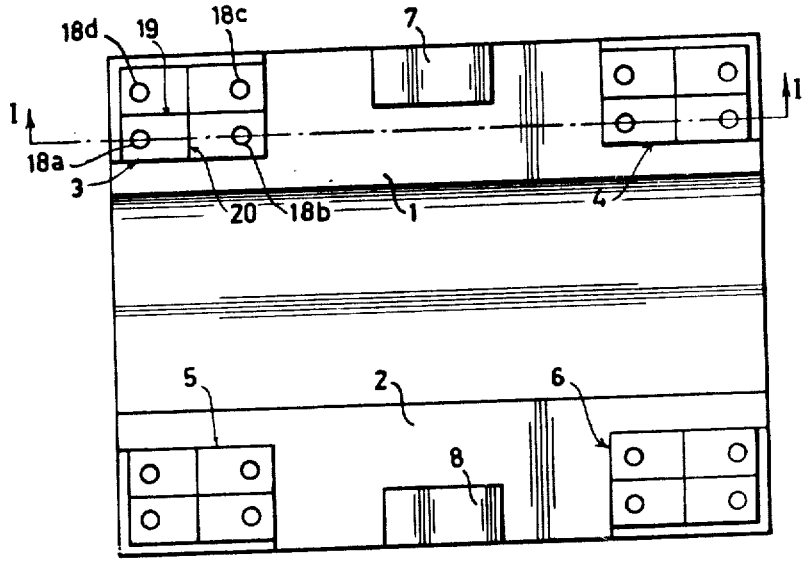
FIG. 2 is a horizontal cross-section taken along line II—II in FIG. 1.

In FIGS. 1 and 2 are seen subaqueous hulls of the vessel 1 and 2, four columns arranged at the ends thereof (hence at the angular points of the vessel as a whole) 3, 4, 5 and 6 and intermediate columns 7 and 8. These columns have a rectangular cross section. The construction connections arranged above and/or below the water level between the hulls 1 and 2 are not illustrated in the drawings nor are similar stiffening connections between the columns mutually and the working platform 14.

Each corner column comprises two chambers, such as for the columns 3 and 4 shown in FIG. 1 these chambers being designated 9, 10, 11 and 12. In each column, one of the chambers is located above the water level 13 and the other therebelow. Before the operation of the crane is started, the upper chambers or water ballast chambers, such as 9 and 11, are full of water and the lower chambers, such as 10 and 12, are full of air. For the invention the water ballast chambers situated above the water level are essential.

The complete system comprises two portions each of which may be used individually or jointly.

The portion here named "active" uses the upper chambers or water ballast chambers and will generally only bring about a rise of the vessel with respect to the water level, namely by chuting out water in connection with crane operations, as will be described below.

The so-called "passive" portion uses the lower chambers such as 10 and 12, and will generally only bring about a settlement of the vessel with respect to the water level by admitting the inlet of water in connection with crane operations.

The rate of rise of the vessel while taking up a load L (see FIG. 3) may exceed the rate of hoist of the hauling winch and has, therefore, a particularly favorable effect on the "loosening" of the load L.

A hauling winch 15 may be positioned, for instance, above the column 4 on the working platform 14.

From the foregoing, it follows that the water ballast compartments situated above the water level 13 of the surrounding water above each of the columns 3–6, just like these columns themselves, are divided along the circumference of the vessel. The water capacity thereof is so chosen in proportion to the maximum Load L to be displaced that by emptying these ballast containers selectively, in a manner which will still be explained hereafter, a sufficient load compensation may be achieved for stabilizing the vessel during the manipulation of loads by the crane. For this purpose, according to the invention, a device for the selective control of water-chute valves is added to the crane commanding device, these valves being referenced 16*a*, *b* respectively 17*a*, *b* in FIG. 1 and located in the water compartments 9 and 11. Each of the water ballast compartments is divided by means of vertical partitions, as indicated in FIG. 2 by reference numbers 19 and 20 for the ballast chamber 3, into four sections and each of these sections is provided with a wide tipping chute for letting out water, as indicated by 18*a–d* in column 3. An appropriate embodiment of the water chute valves, such as 16*a*, *b*, 17*a*, *b* will be described hereafter and also the manner in which these are discharged under convenient control.

Each complete crane operation generally consists of a number of consecutive part-operations in which two different types are distinguished which will be indicated hereafter as the "load operation" and the "operation on the spot".

In the case of load operation, a load is taken up (loosened) exclusively from, respectively put on, a strange support and, therefore, there occurs a change of load with respect to the vessel.

In the case of operation on the spot, the load is displaced exclusively with respect to the vessel and, therefore, there occurs no change of load.

For the complete or partial automation of the device for the selective control of the abovementioned discharged valves and of the valves 33, 34, 33', 34' of the lower compartments still to be mentioned hereafter, added to the crane commanding device, an expedient use is made of a calculating machine into which various data are fed by indicators, such as the water level in both kinds of compartments and the crane vertical angle and swing angle. A system for this purpose with measuring devices has been described in our copending USA-application Ser. No. 769,002, now abandoned. The data may also be made known on the spot of the commanding device.

For each of the part operations, an individual computer program may be used in which the size of the load may be fed as a datum, so that there is no longer need for measuring it continually.

Furthermore, in addition to a completely automatic command, also an efficient and clear manual command becomes possible, namely a programized manual command in which use is made of compensation data on behalf of the stabilization supplied by the adding machine and possibly made visual.

The following explanation with reference to practice examples comprises rough calculations based on a simple two-dimentional model according to FIGS. 3–7 with two columns 3 and 4, one of which has crane 15 therein. These considerations are without more also applicable in the case of FIGS. 1 and 2 in which the columns 4 and 6 jointly support a derrick, as a special case of an arrangement of a crane.

The numerical values for the various sizes and magnitudes have been chosen according to the following table, with reference to FIG. 3.

$G = 70000$ kg.$10^3$ total water displacement
$L = 2800$ kg $10^3$ crane load
$W = 1400$ m$^2$ water-surface traverse
$K = 625$ m$^2$ cross section of chamber
$m = 20$ m metacenter height
$r = 30$ m working radius of crane
$a = 30$ m column-middle centre distance
$b = 40$ m gangway center distance
$k = 10$ m height of chamber
$n = 10$ m average height of pressure upper chamber
$q = 20$ m average air overpressure
$h = 100$ m height of crane top above water.

The following are some rough calculations:

a. Load operation, lifting a load from a strange support (FIG. 3)

Start: upper chamber $A_2$ full of water.

It is desired that after completion of the operation, the slope of the deck of the working platform has not changed.

Use exclusively the active system.

Water to be discharged from upper chamber $A_2$ $V = (r + a/a)L = 5600$ m tons.

Herein rise of the deck: $s = V - L/W = 2$ m.

Settlement of water level in $A_2$: $k_A = V/K = 9 < k = 10$ m.

Fix the time admitted for the operation at $t = 15$ seconds

Water volume $V = 5600$ m$^3$ should then flow out in t seconds.

With an outlet with a total cross section U of the chute pipes 21, the rate of discharge of the water is $v=V/U.t$.

There exists a relation between the available pressure difference and the rate of discharge.

The loss of pressure at discharge into the surrounding water is:

$\Delta p_u=\rho/2V^2$ in which: specific mass of water $\rho=1000$ kg/m$^3$.

The total loss of pressure in case of a reasonable construction of the valves 16, 17 may be assumed to be:

$$\Delta p_1=1.2\rho/2V^2=0.6V^2 \text{ or } V=\sqrt{p/0.6\rho}$$

The average level difference available is:

$\Delta p = n \cdot 10^4\ N/m^2$, therefore $\Delta p_1 = \Delta p$ or rate of discharge:

$$V=\sqrt{\frac{n\cdot 10^5}{0{,}6}}=\sqrt{\frac{10\cdot 10^5}{0{,}6.1000}}=13 \text{ m/sec.}$$

Required cross section of outlet $U=V/v.t.\cdot 5600/13.15=28.5$ m$^2$.

This may be disposed of in, for instance, four chute pipes, such as 21*a–d* with diameter $=U/\pi=3$ m.

Maximum magnitude of the starting force: $P_A=k\cdot U=10\times 28.5=285$ tons.

If this force is compensated for 95% (as will still be explained later), the starting force required is:

$$p_A=0.05\cdot 285=14 \text{ tons.}$$

With four valves per chamber, a maximum of 3.5 tons per valve is required.

During the discharge, the impulse activity causes an upward force I on the column.

Average: $I=U\cdot\frac{1}{2}V^2=28.5\cdot\frac{1}{2}1000\cdot 13^2=240\cdot 10^4$N or 240 tons.

Figure 4:
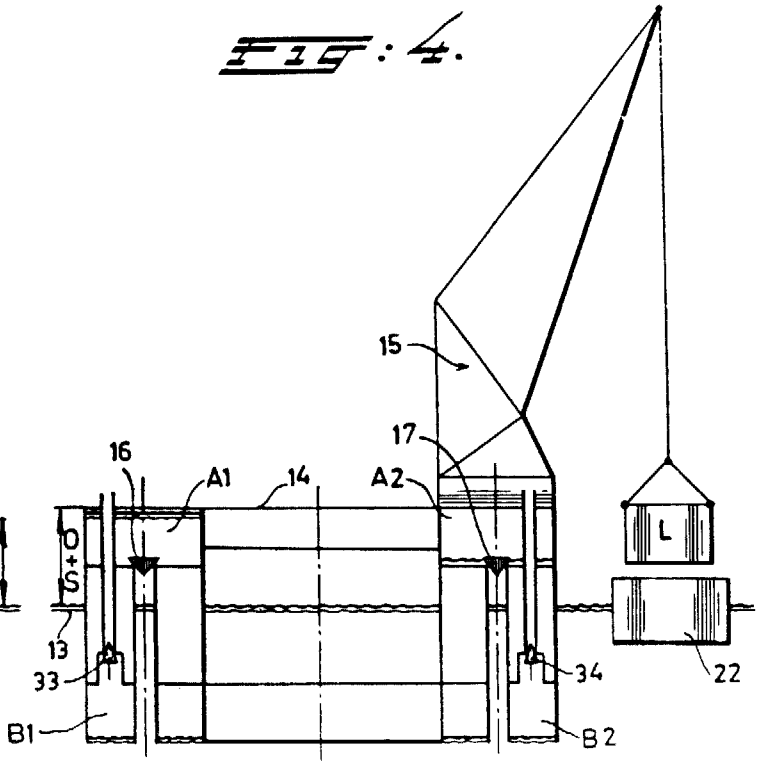

The situation after loosening load L from the support, in this case a barge 22, is illustrated in FIG. 4: chamber $A_2$ has been emptied, deck 14 has remained horizontal.

b. Operation on the spot. Displacement of the load lifted according to FIG. 4 to the middle of the deck and lowering it there, if desired Without further explanation, it is clear that with a derrick the load L may be topped and that a corresponding calculation with valve manipulation of the valve 16 (FIGS. 3 and 4) may be applied, for which purpose the chamber $A_1$ is discharged down to the same level formed in chamber $A_2$ according to FIG. 4 during which operation the deck 4 may remain horizontal and the situation according to FIG. 5 is brought about.

For operations on the spot in which a crane 15 is swung, the calculations on the basis of the two-dimensional model are less to the point. For maintaining the deck at a certain height, both systems, i.e. the "active" ($A_1$, $A_2$) and the "passive" ($B_1$, $B_2$) which will be discussed below, will have to be used simultaneously.

c. Load operation, lowering load L on a strange support

Figure 5:
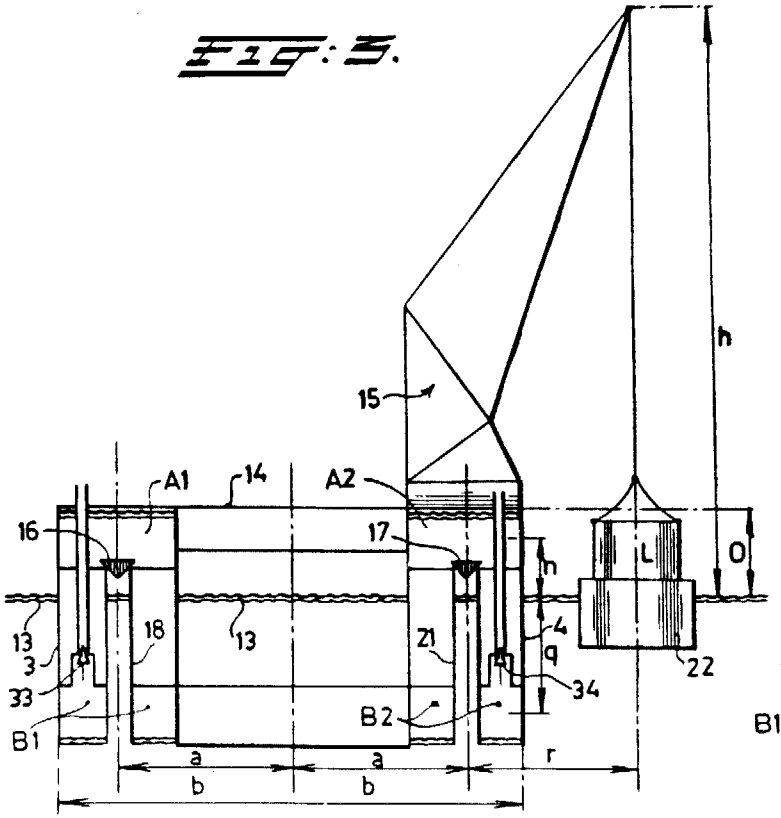
Figure 5:
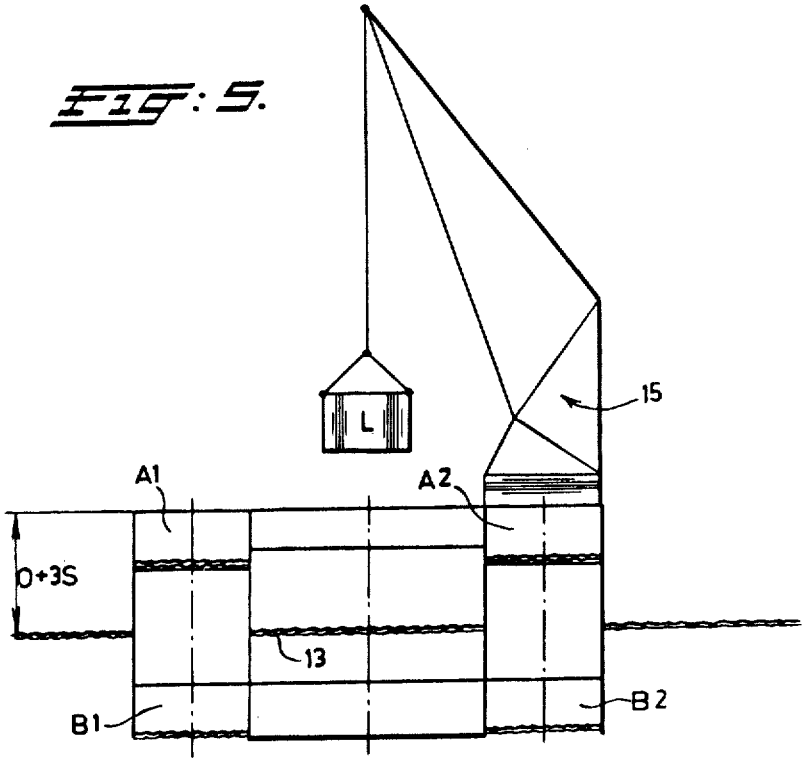

The initial position of the water levels in the chambers $A_1$ $A_2$ and $B_1$, $B_2$ as illustrated in FIG. 5. So, at the start the lower chambers $B_1$ and $B_2$ are empty. However, the load is now first again turned outboard for which purpose the passive system is used and the chamber $B_2$ is filled with water by application of means to be discussed hereafter.

With reference to FIGS. 1 and 2, the chambers 10 and 12 located below the water ballast chambers 9 and 11 in the columns, such as 3 and 4, have already been mentioned. In the two-dimensional model according to FIGS. 3–7, the firstmentioned chambers are indicated by $B_1$ and $B_2$.

In the latter Figures, these are shown as diving-bell-shaped chambers at the lower end of each column. As is evident from FIG. 1, these are located higher in the column in a favorable practical embodiment, so that the ceiling of the chambers (for the chamber 10 referenced 23 in FIG. 1) will be located at about sealevel 13. They may be emptied by the supply of air through a line 25 fed by compressors 24 with branches 26 to the various compartments into which the chamber 10 is divided by means of vertical partitions. Alternatively, emptying of these chambers may also be done by pumping water from these chambers to the upper chambers 9 and 11 after the closure of water valves as indicated by 33' and 34' in dotted lines. The "air" line 26 is then replaced by a water pump line (not shown) connected with chambers $B_1$ $B_2$ just above the bottom thereof.

Each compartment has at its lower end a wide connection 28 with the surrounding water, but around thereof the space 29 in the column is separated through which also the chute-pipes 18*a,b,* for water ballast are conducted downwards and they may also serve as useful storage rooms for the subaqueous hulls 1 and 2, for letting through propeller shafts, and the like The high position of the air chambers, such as 10, is advantageous in the case of feeding air therein for emptying them from water as then only a relatively low air-pressure will be required. For the supply of air, valves 30 are arranged in the air line 26, these valves being commandable from the stabilization commanding device added to the crane commanding device connectible with a calculation machine or operated manually.

The same applies to the valves 31 arranged in the branches 32 of the air discharge pipe 33 leading to each of the compartments of the chamber 10. In the simplified illustration in FIGS. 3 and 4, these valves, jointly for each of the chambers $B_1$ and $B_2$ are indicated by 33 respectively 34. Just like the valves 17 for the upper ballast-water command, these are nonreturn valves. By means of an external, for instance hydraulic, excitation, these valves commanded from the said added stabilization command devices, may be opened. They tend to be closed by the respective flow of air or water. Thanks to these highspeed nonreturn valves, the entire system may be stopped immediately and reliably, possibly at the same time as the crane drive, in case of emergency.

Figure 6:
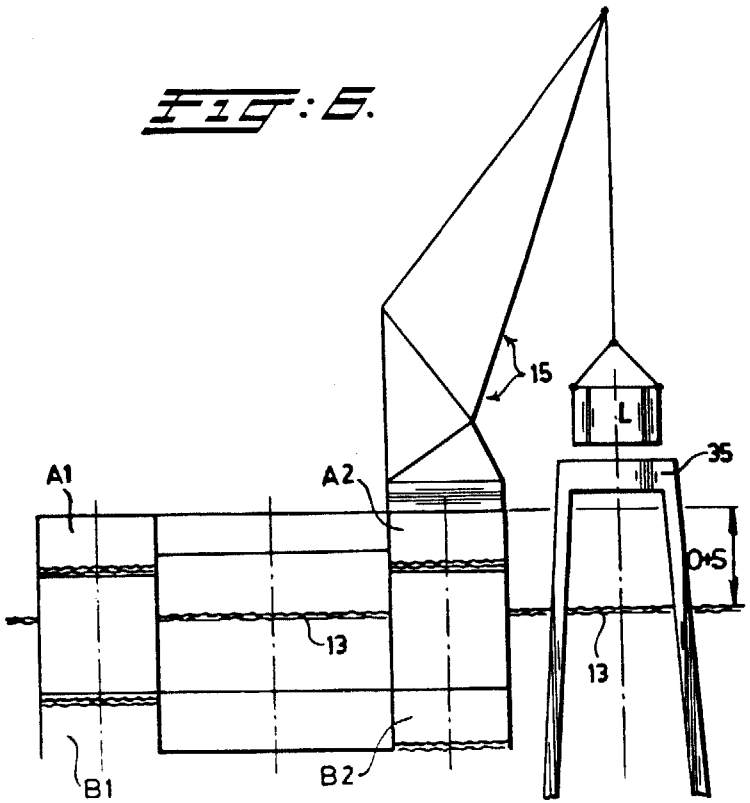

The load operation to be discussed now with reference to FIGS. 6 and 7 (placing load L on an outward or strange fixed support 35) is carried out with the passive system and the discussion is entirely analogous to that of lifting the load L, the waterflow, however, being replaced by air flow.

Water to be let into the lower chamber $B_2$ $V=(r+a/a)L=5600$ m tons.

Settlement of the deck: $d=V-L/W=2$ m.

Rise of water level in $B_2$: $k_B=V/K=3 < k=10$ m.

Operation time allowed: $t=15$ sec.

Air volume $V=5600$ m$^3$ should then flow out in t sec.

With an outlet with diameter U, the rate of the airflow is: $V=V/U.t.$.

The loss of pressure at discharge into the open air amounts to: $\Delta p_u=\rho/2V^2$ in which the specific mass of air $\rho=1.3$ kg/m$^3$.

Total loss of pressure in case of a reasonable structure:

$$\Delta p_1 = 1.2\frac{\rho}{2}v^2 = 0.6\rho V^2 \text{ or } V = \sqrt{\frac{\Delta p}{0.6\rho}}.$$

Available on an average: $p = q \cdot 10^4\ N/m^2$, so $\Delta p_1 = \Delta p$ and rate of discharge $V = \frac{q \cdot 10^4}{0.6} = \frac{20 \cdot 10^4}{0.6 \cdot 1.3} = 506$ m/sec.

Required discharge diameter $U = \frac{V}{v.t.} = \frac{5600}{506.15} = 0.75\ m^2$ This may be disposed of in, for instance, four containers with diameter $\sqrt{U/\pi} = 0.5$ m.

Minimal total starting force $p_B = q \cdot U = 20 \cdot 075 = 15$ tons is compensated for 95% to: starting force $p_B \cdot 0.05 \cdot 15 = 0.75$ tons. With four valves per chamber, maximum required 0.2 ton per valve. The impulse activity brings about a downward force:

$$I = U \cdot \tfrac{1}{2}\rho V^2 = 0.75 \cdot \tfrac{1}{2} \cdot 1.3 \cdot 506^2 \cdot 12.5 \cdot 10^4 N = 12.5 \text{ tons.}$$

d. Charging an upper chamber

The waterpump (not shown) should overzome the average level difference n, therefore net energy required:

$$A = 10\ nVkNm \qquad V = 5600\ m^3 \text{ of water}$$

at a charging time T = 1800 sec. or 30 mm, and a total efficiency of $\eta = 0.6$ electric charging capacity $N = 10nV/\eta T = 10.10.5600/0.6.1800 = 519$ kW.

e. Charging a lower chamber

A compressor should overcome an average pressure difference of q = 20, in other words, compensate open air (absolute pressure 10 m) to absolute pressure 10 + q = 30.

Net energy required at isothermic compression:

$$A = 10(10+q)V\ln(10+q/10)kNm,\ V = 5600\ m^3 \text{ of air}$$

in a charging time of T = 1800 sec. or 30 mm, and a total efficiency of $\eta = 0.6$ electric loading capacity of $N =$ $$\frac{10(10+q)V}{\eta T}\ln\frac{(10+q)}{10} = \frac{10.30 \cdot 5600}{0.6 \cdot 1800}\ln\frac{30}{10} = 1709 \text{ kW.}$$

f. Load operation, lifting a load without compensation.

This operation may be replaced by putting a load L in the center and arranging a moment (a + r)l.

Putting in the center:

settlement $d_1 = L/W = 2800/1400 = 2$ arrangement of moment (a + r)L angular displacement = (a + r)L/m = 60.2800/20.70000 = 0.12 rad or 7° resulting settlement of load (a + r) = 0.12·60 = 7.2 m

| | |
|---|---|
| Settlement gangway crane side<br>rise gangway back | ab = 4.8 m |
| total: | |
| settlement of load | 7.2 + 2 = 9.2 m |
| settlement gangway crane side | 4.8 + 2 = 6.8 m |
| rise gangway back | 4.8 − 2 = 2.8 m |

So at a rate of hoist of 4.5 m/m, with a fixed strange support, 9.2/4.5 = 2 minutes are necessary for loosening the load without using the compensation system.

Herein, the horizontal displacement of the crane top is about h = 0.12·100 12 m.

This distance should be settled by means of topwinches in the course of the operation.

With reference to FIGS. 8a–9b, the construction of a valve 16 on a water ballast pipe 18 is now described. The valve comprises a cylindrical mantle 36 provided with an inner ring on the upper edge and with an outer ring 38 on the lower edge.

Via a stiffening ring 39, the chute pipe 18 is connected with the bottom 40 of the compartment of the relative water ballast chamber 9.

The valve mantle 36 is guided along the outside of a ring 41 which is arranged fixedly and centrally in respect of the pipe 41, in which ring a cover 42 is arranged curved downwards-inwards around its center. As a result of this configuration, the water discharged at the open position of the valve 16 (FIG. 2) according to the arrows P is bypassed to the pipe 18 with the least possible resistance. The latter, also for the purpose of stream losses, is divided by means of radially directed, vertical partitions 43. The curvature of the upper face 42 of the pipe also provides sufficient strength against the water pressure.

The ring 39 also forms a valve seat on which, in the closed position of the valve of FIG. 1, an annular packing 44 fixed in the outer ring 39 of the valve is arranged. The packing at the upper edge of the mantle is obtained by a similar packing 45 in the inner ring of the valve 37 which, in closed position, will rest on the fixed ring 41. The distance from the ring 41 to the ring 39 has so been chosen that around and between them a flow surface is formed which corresponds with the diameter of the surface of the pipe 18.

On the ring 37 there is further arranged a cap 46 to which the operating rod 47 is arranged in the center. This may be pulled up in the direction of the arrow P, for instance as a plunger rod of a hydrocylinder, as a result of which also a centration is obtained.

The cap 46 is provided with apertures 48 so that normally there is water in the space between this cap and the pipe face 42.

Lowering the sliding valve formed by the mantle 36 can never take place under the influence of the water pressure with an inadmissible shock, since then the water should flow out of the space between terminal 42 and cap 46 through the apertures 48, thus causing a brake action. Furthermore, it may be recognized that the pressure difference to be overcome when opening the valve is defined only by the surface of an annular zone with width X, being the horizontal distance between the central circles of the packings 44 and 45.

Summarizing, a number of important features conspicuous from the foregoing are mentioned:

a. the construction of the whole is relatively cheap. No heavy compressors and voluminous vessels for compressed air are required for making available an adequate supply of air with high pressure;

b. the rise of the capacity as a result of water ballast being available above sea level facilitates the lifting and lowering of loads on strange supports;

c. This rise of capacity and the application of two separate systems ("active" and "passive") working parallel to each other makes also a programmized command possible in addition to fully automatic command;

d. application of excited nonreturn valves means an important contribution to the safety of the system;

e. such an economy of energy is achieved that the entire system may be charged in a relatively short time with a relatively low capacity of simple compressors and pumps;

f. it is possible, also on turbulent sea, to lift a crane load of, for instance, 3000 tons from a strange support, loosening it in 15 seconds, while the deck never deviates more than 1° from the original (horizontal) position.

Speedy discharge of the water from the upper chambers to the surrounding water is imperative. For this purpose, very wide discharge lines with corresponding valves are indispensable. However, in the manner indicated it has been found to be possible to solve this special problem in a relatively simple and cheap manner.

It is possible to calculate the entire development of a load operation and feed it into computer programs, this as an important auxiliary for obtaining an optimal command system, both as regards the fully automatic command and the visually guided manual command.

Hereafter, several further embodiments and applications are enumerated:

I. If both active (water) compartments and passive (air) compartments are arranged in all of the four corner columns, the following compensation operations are possible:

(a) In all crane operations occurring, the platform can be held horizontal and at equal draft (then the compensation is both active and passive).

(b) Compensation can take place active only, maintaining the horizontal position. Generally the draft of the vessel will then decrease (this manner of manipulation is suitable for lifting a load).

(c) Compensation can take place active, maintaining the horizontal position. Generally the draft of the platform will increase. (this manner of manipulation is suitable for lowering a load).

II. If both active and passive compensation chambers are arranged in only two of the corner columns, no possibilities of compensation being available in the remaining columns, the platform may be kept horizontal in all crane operations, but the draft cannot be affected.

III. If exclusively active ballast chambers are arranged in all of the four corner columns, compensation is only possible in the case described above sub Ib.

It is observed that, in certain circumstances, it may be sufficient to compensate the weight of the load under the crane exclusively by lifting and lowering the load and to allow angular displacement of the crane without compensation whilst swinging.

Furthermore, in the course of the compensation, it is possible in all of the systems mentioned, instead of keeping the deck horizontal, (declination of the angle 0°), to effect intentionally a certain change of declination with a downward declination to the side of the load.

This may, for instance, be useful for lifting a load very quickly by means of the compensation system (for instance from a barge riding the waves).

Furthermore, it may be understood from the foregoing that the quick discharge of water ballast located above sea level may be applied to a considerable extent for lifting loads from a surface outside the vessel and for putting it on a similar surface, independent of the movement of the crane. In fact, the side of the vessel where a crane is arranged on the load may quickly be moved upwards for taking up the load by discharging water ballast, so that in this manner already the load may be loosened from the bearing surface.

It is also important that this may be done in a very short lapse of time so as to be less dependent on the motion of the waves.

It has been indicated already that it is possible to apply an entire water system. The surrounding water should then flow in through large commandable nonreturn valves as indicated by 33' and 34' instead of the air valves 30. Though such an embodiment may be a little more vulnerable in some respects than an air system with compressors for the lower chambers, it has the advantage that it is simpler and that the water, pumped from the lower chambers in order to empty them when preparing for another crane operation, can be pumped into the chambers above sea level for ballasting these.

What is claimed is:

1. A stabilizing system for a crane vessel comprising an upper structure having subaqueous hulls having hollow columns, a working platform on said upper structure above the level of the surrounding water and provided with crane means for displacing outboard relatively heavy loads over 250 tons, for instance 3000 tons, ballast water compartments above the water level, in the upper structure of the vessel, chute lines connecting the water ballast compartments with the surrounding water, discharge valves in said chute lines, said valves being located at the bottom of the ballast water compartments above water level, said ballast water compartments being divided along the circumference of the vessel for a water capacity in such a proportion to the maximum load to be displaced by the crane means, that by selectively discharging said ballast tanks, under the control of said discharge valves in said chute lines from the water compartments to the surrounding water a load compensation can be achieved, and means for selective control of said water discharge valves for the various water compartments in dependence on the moment of force applied to the vessel by the load being added to the crane means.

2. The crane vessel of claim 1 wherein said hollow columns extend between the subaqueous hulls and the working platform at least at the corners of the vessel, the ballast water compartments above sea level being located at the upper part of each of said columns.

3. A crane vessel as defined in claim 2, wherein in the lower portion of each of the columns which are provided with water ballast compartments in their upper portion, lower water ballast compartments are arranged whose upper surface is located substantially at sea level and which, on the lower side have widely dimensioned connections with the surrounding water and on the upper surface an air discharge line to the open air.

4. A crane vessel as claimed in claim 3 comprising valves connecting the lower water ballast compartments in the columns with the surrounding water, the said lower compartments each being connected with a water pumpline leading to the upper water ballast compartment of the same column.

5. A crane vessel as defined in claim 1 wherein the chute lines of said upper water ballast compartments each comprises a wide chute pipe, each said discharge valve controlling the inlet of a respective said chute, said valve being a non-return valve which is closed under the influence of the outflowing medium, and emergency control means for closing the valves.

6. A crane vessel as defined in claim 1, wherein said control means is active simultaneously on both means controlling the crane means and on the means for selective control of said ballast compartment valves.

7. A crane vessel as defined in claim 1, wherein said means for selective control of the said valves comprises a computer, measuring means for the values of the water levels in the ballast compartments, of the inclination of the vessel and of the swing- and top-angle of the crane, said values being fed into the computer as computer data and means for connecting the valve control means for fully automatic or guided manual control.

8. The crane vessel of claim 7 comprising means for dividing a complete crane operation into part-operations as load operations and operations on the spot including a separate computer program available for each of these operations for the measured values of crane load moment forces.

9. A crane vessel as defined in claim 8, wherein the means for controlling the valves in the upper and in the lower water ballast compartments are each connectible individually as active and passive part systems for the respective outboard lifting and lowering of a load.

10. A crane vessel as defined in claim 7, wherein the means for manual control comprises a control device fed with data obtained from the computer.

11. A crane vessel as defined in claim 1, wherein said discharge valves each comprises a cylindrical slide movable axially above the inlet of the chute, said slide controlling water bypass between two valve seats rings arranged concentrically one above the other, the upper ring forming a guide for the slide which, in closed position, by means of an inner ring along the upper edge co-operates with the upper ring of the valve seats as a packing, and with an outer ring around the lower edge which co-operates as a packing with the lower ring of the valve seat arranged around the upper edge of the chute, the upper seat ring constituting the edge of an upper chute closure plate which is inwardly and downwardly curved to a lowest center at about the level of the plane of the lower seat ring.

12. The crane vessel of claim 11, wherein the upper ring of the cylindrical slide is provided with a perforated conical cap with an upward top, and an axial operating rod of the slide engaged at said top.

13. A crane vessel as defined in claim 2 wherein said columns have a rectangular cross-section and only the corner columns are provided with water ballast compartments, and columns with a smaller diameter are placed therebetween along the length of the vessel.

* * * * *